US009137606B2

(12) United States Patent
Akino

(10) Patent No.: US 9,137,606 B2
(45) Date of Patent: Sep. 15, 2015

(54) ELECTROSTATIC ELECTROACOUSTIC TRANSDUCER AND METHOD OF MANUFACTURING THE SAME

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/492,849

(22) Filed: Sep. 22, 2014

(65) Prior Publication Data

US 2015/0098606 A1 Apr. 9, 2015

(30) Foreign Application Priority Data

Oct. 3, 2013 (JP) ..... 2013-207956

(51) Int. Cl.

| | |
|---|---|
| ***H04R 25/00*** | (2006.01) |
| ***H04R 7/18*** | (2006.01) |
| ***H04R 17/00*** | (2006.01) |
| *H04R 19/04* | (2006.01) |
| *H04R 19/02* | (2006.01) |

(52) U.S. Cl.

CPC ..... *H04R 7/18* (2013.01); *H04R 17/00* (2013.01); *H04R 19/02* (2013.01); *H04R 19/04* (2013.01); *H04R 2207/00* (2013.01); *H04R 2307/207* (2013.01)

(58) Field of Classification Search

USPC ..... 381/174, 190, 191

See application file for complete search history.

(56) References Cited

U.S. PATENT DOCUMENTS

2012/0230524 A1 * 9/2012 Chang et al. ..... 381/190

FOREIGN PATENT DOCUMENTS

JP 2005-086831 A 3/2005

* cited by examiner

*Primary Examiner* — Davetta W Goins
*Assistant Examiner* — Amir Etesam
(74) *Attorney, Agent, or Firm* — Manabu Kanesaka

(57) ABSTRACT

When a diaphragm formed in the shape of an oval is held by a holding member, an electrostatic electroacoustic transducer which allows stable tension without a diaphragm flexing is provided. In the electrostatic electroacoustic transducer, a diaphragm 11 and a diaphragm holding member 12 are formed in the shape of an oval, and is provided with a corrector member 21 which presses inwardly from outside both side ends on a major axis of the oval diaphragm holding member, and opens and deforms outwardly a pair of opposed long sides 12*a* and 12*b* on a minor axis side of the diaphragm holding member.

3 Claims, 6 Drawing Sheets

ELECTROSTATIC ELECTROACOUSTIC TRANSDUCER AND METHOD OF MANUFACTURING THE SAME

BACKGROUND OF THE INVENTION

1. Field of the Invention

The present invention relates to an electrostatic electroacoustic transducer and a method of manufacturing the same, and more particularly to an electrostatic electroacoustic transducer and a method of manufacturing the same applicable to a condenser-type microphone and headphone which use a change in capacitance between a diaphragm and a fixed electrode plate wherein the above-mentioned diaphragm can be attached without being flexed with respect to a holding member.

2. Description of the Related Art

In recent years, electronic devices including a mobile phone are reduced in size and their interior spaces are also small. Many of the above-mentioned small electronic devices include electrostatic electroacoustic transducers, such as a condenser microphone and a capacitor loudspeaker. Therefore, there is an inevitable need for a miniaturized microphone unit or loudspeaker unit.

However, in the above-mentioned electrostatic electroacoustic transducer, the shape of the diaphragm arranged to face a fixed electrode plate is generally designed to have a precise circle. Therefore, when it is installed in the interior space of the above-mentioned electronic device whose cross or vertical section is rectangular, the above-mentioned precise circular shape of the diaphragm is not one that can utilize the above-mentioned interior space efficiently.

In view of such problems, Japanese Patent Application Publication No. 2005-86831 discloses a variable capacitance microphone in which a planform of a microphone unit including a diaphragm is in the shape of an oval (like athletic field track), for example. Further, it also discloses such a variable capacitance microphone which efficiently uses the interior space of the small electronic device as described above. According to the structure of the microphone as disclosed in Patent Document 1, a cross-sectional area of the microphone unit is greater than that of the conventional one which is completely circular. Therefore, as to the interior space of the small electronic device like a mobile phone, the minimum wasted space is occupied in the interior space. Further, since the effective area of the diaphragm is large, it is possible to obtain the effects of increasing the sensitivity of the microphone unit.

Incidentally, as described in Patent Document 1, the diaphragm is adhered to and held by a frame-like holding member (diaphragm plate) in the microphone unit.

However, when the diaphragm is in the shape of an oval, the long sides (which face each other on the minor axis side) of the holding member formed into the shape of an oval according to the diaphragm are deformed or bent towards the diaphragm by the tension of the diaphragm. As a result, the diaphragm is flexed between the long sides, and the tension of the diaphragm is reduced. Therefore, there is a problem that it is difficult to manufacture the transducer having the diaphragm with stable tension.

SUMMARY OF THE INVENTION

The present invention has been made in view of the above-mentioned problems and aims to provide an electrostatic electroacoustic transducer and a method of manufacturing it, wherein when a diaphragm formed in the shape of an oval is held by a holding member, stable tension can be obtained without a diaphragm flexing.

In order to solve the above-mentioned problems, the electrostatic electroacoustic transducer in accordance with the present invention is characterized by having a fixed electrode plate, a diaphragm arranged to face the above-mentioned fixed electrode plate and formed in the shape of an oval, a diaphragm holding member formed in the shape of a frame and in the shape of an oval for holding the periphery of the above-mentioned diaphragm, and a corrector member which presses inwardly from outside both side ends on a major axis of the above-mentioned oval diaphragm holding member, and stretches and deforms outwardly a pair of opposed long sides on a minor axis side of the above-mentioned diaphragm holding member.

In addition, it is desirable that the above-mentioned corrector member has a support frame arranged so as to surround the periphery of the above-mentioned diaphragm holding member, and pressing members provided to project from the support frame side toward both the side ends on the major axis of the above-mentioned diaphragm holding member and inwardly press both the side ends on the major axis.

Further, it is desirable that the above-mentioned pressing members are screws threadedly engaged with the above-mentioned support frame so as to be moveable in relation to both the side ends on the major axis of the above-mentioned diaphragm holding member.

According to such a structure, when the diaphragm formed in the shape of an oval is held by the diaphragm holding member formed of an oval-shaped frame, both the side ends on the major axis of the above-mentioned diaphragm holding member are pressed inwardly.

Thus, the diaphragm is in a stable state where it is not bent or flexed, since the pair of long sides which face each other on the minor axis side of the diaphragm holding member are deformed in the direction to stretch outwardly.

That is to say, according to the electrostatic electroacoustic transducer in accordance with the present invention, it is easy to manufacture the oval-shaped diaphragm in a situation where its tension is stable. Further, since the diaphragm is in the shape of an oval, it is possible to efficiently use the interior space of a small electronic device like a mobile phone. Furthermore, since the effective area of the diaphragm is large, it is possible to obtain the effect of increasing the sensitivity.

Still further, in order to solve the above-mentioned problems, the method for manufacturing the electrostatic electroacoustic transducer in accordance with the present invention includes the steps of holding a mother film of a diaphragm to which tension is applied uniformly, attaching a diaphragm holding member formed of an oval-shaped frame to the above-mentioned mother film through an adhesive, releasing tension applied to the above-mentioned mother film, cutting off a portion of the above-mentioned mother film at the periphery of the above-mentioned diaphragm holding member, and pushing inwardly from outside both side ends on a major axis of the above-mentioned diaphragm holding member.

In addition, it is desirable that the step of pressing inwardly from outside both the side ends on the major axis of the above-mentioned diaphragm holding member includes the steps of arranging a support frame so as to surround the periphery of the above-mentioned diaphragm holding member, and providing the pressing members to project from the support frame side toward both the side ends on the major axis of the above-mentioned diaphragm holding member and inwardly press both the side ends on the major axis.

According to such a manufacture method, it is possible to easily manufacture the electrostatic electroacoustic transducer in a situation where the tension of the oval-like diaphragm is stabilized. Further, since the diaphragm of the thus manufactured electrostatic electroacoustic transducer is in the shape of an oval, it is possible to efficiently use the interior space of a small electronic device like a mobile phone. Furthermore, since the effective area of the diaphragm is large, it is possible to obtain the effect of increasing the sensitivity.

According to the present invention, when the diaphragm formed in the shape of an oval is held by the holding member in the electrostatic electroacoustic transducer, it is possible to obtain stable tension while keeping the diaphragm free of flexing.

DESCRIPTION OF THE PREFERRED EMBODIMENTS

Hereinafter, the preferred embodiments of the present invention will be described with reference to the drawings.

Figure 1:
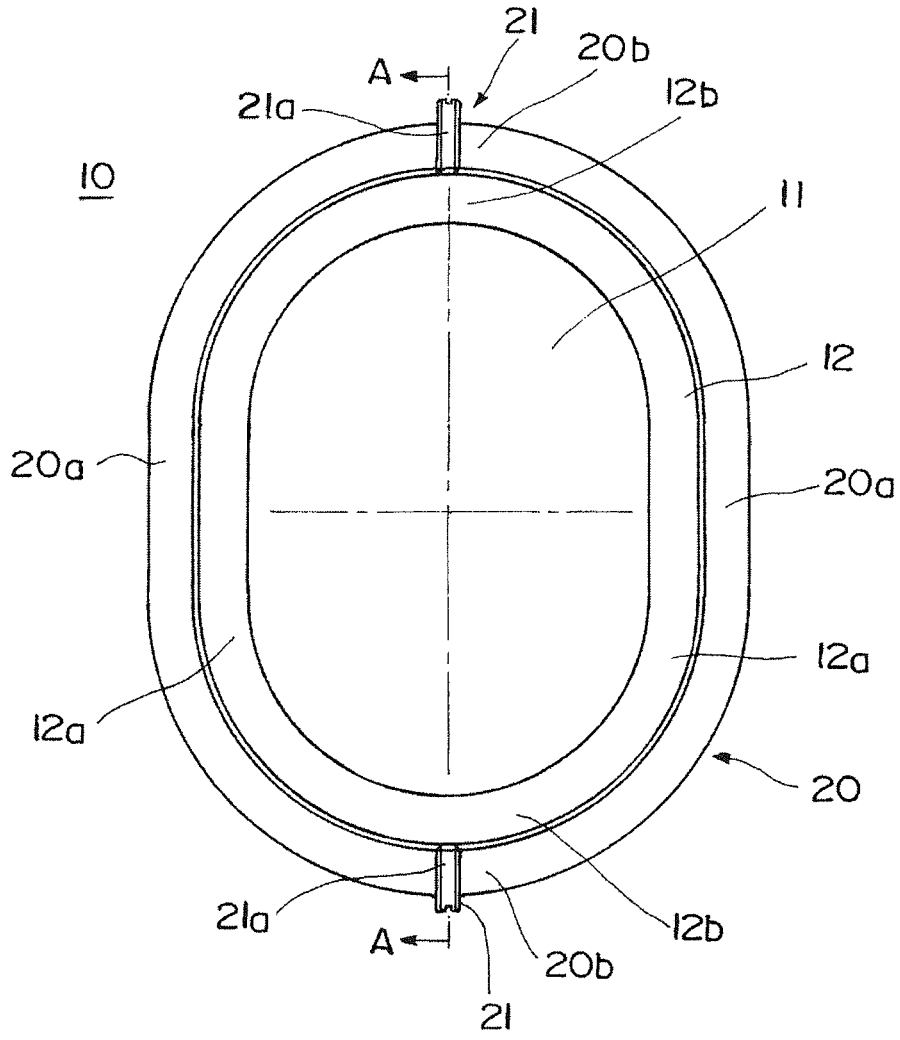
FIG. 1 is a plan view of an electrostatic electroacoustic transducer in accordance with the present invention.
Figure 2:
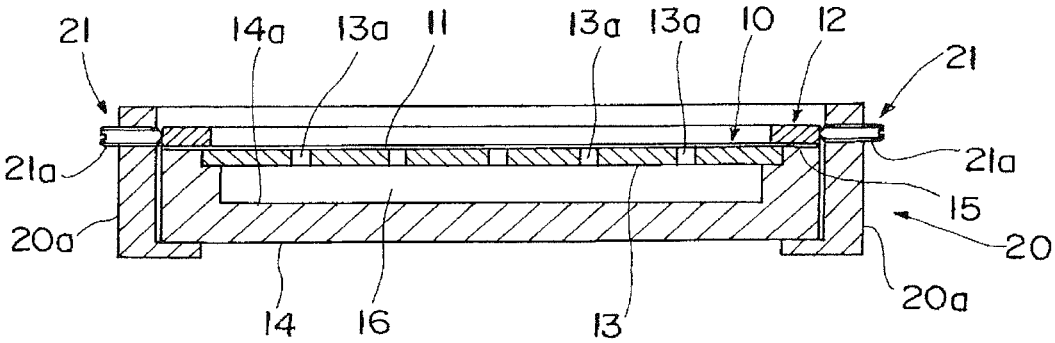
FIG. 2 is a sectional view of the electrostatic electroacoustic transducer of FIG. 1 taken along the line A-A.

FIG. 1 is a plan view of an electrostatic electroacoustic transducer in accordance with the present invention. FIG. 2 is a sectional view of the electrostatic electroacoustic transducer of FIG. 1 taken along the line A-A.

It should be noted that a case where the electrostatic electroacoustic transducer in accordance with the present invention is applied to a condenser microphone will be described by way of example in the following description. However, the same structure can be applied to a condenser-type headphone or loudspeaker.

As shown in FIGS. 1 and 2, the condenser microphone in accordance with this preferred embodiment is provided with a microphone unit 10 in which a diaphragm has an oval-like shape (shape of an athletic field track) in plan view.

The above-mentioned microphone unit 10 is constituted by a diaphragm 11 tensioned by a diaphragm ring 12 and a fixed electrode plate 13 supported by an insulation seat 14 which are arranged to face each other via a separator ring 15. In the present invention, the diaphragm ring 12 is formed as a frame in the shape of an oval, analogous or conformal to the diaphragm 11.

That is to say, the diaphragm ring 12 has a pair of elongated side frame portions 12*a* and 12*a* which face each other on the minor axis side and are parallel with each other, and a pair of arcuate frame portions 12*b* and 12*b* which face each other on the major axis side. The diaphragm ring 12 is made of a metal, and may be made of an aluminum material, a brass alloy, etc, for example.

Further, a thin synthetic resin film which has a metal deposition film on one side is used for the diaphragm 11. As for diaphragm 11, the metal deposition film side is adhered to the diaphragm ring 12 through an adhesive etc. to give a diaphragm assembly.

Furthermore, the separator ring 15 as well as the diaphragm ring 12 is formed as an oval-shaped frame. The separator ring 15 formed of a synthetic resin film which is electrically insulative.

Still further, the fixed electrode plate 13 is similarly formed in the shape of an oval since the diaphragm 11 is oval-shaped. For example, an aluminum plate is used for the fixted electrode plate 13. In this preferred embodiment, the fixed electrode plate 13 is constituted by the aluminum plate in which a plurality of sound holes 13*a* are formed. It should be noted that an electret film may be adhered to the fixed electrode plate 13 on the side facing the diaphragm 11 to give a back electret-type condenser microphone.

Yet further, the insulation seat 14 is made of a synthetic resin material which is electrically insulative. In this preferred embodiment, the insulation seat 14 is provided with a recess 14*a* for forming an air room 16 having a predetermined volume of space in the back of the fixed electrode plate 13. An acoustic resistor material (not shown), such as nonwoven fabric etc., may be provided in the air room 16. Further, the insulation seat 14 may be of a ceramic material.

The microphone unit 10 is arranged in a unit cover (not shown) in a situation where it stands substantially perpendicularly on a microphone base (not shown) via amount member including a support frame 20 which surrounds the diaphragm ring 12.

In this preferred embodiment, since the diaphragm ring 12 is in the shape of an oval, the support frame 20 is also in the shape of an oval and has a pair of elongated side frame portions 20*a* and 20*a* which face each other on the minor axis side and are parallel with each other, and a pair of arcuate frame portions 20*b* and 20*b* which face each other on the major axis side.

Further, the support frame 20 has a corrector member 21 which presses, from the outside, the arcuate frame portions 12*b* and 12*b* which face each other on the major axis side of the diaphragm ring 12. The pressing force of this corrector member 21 deforms the elongated side frame portions 12*a* and 12*a* which face each other on the minor axis side and adjusts tension so that the diaphragm 11 may not be flexed or bent.

As illustrated, this corrector member 21 has screw members 21*a* and 21*a* (pressing members) which are provided to project from the support frame 20 side toward both the side ends on the major axis of the diaphragm ring 12 and press both the above-mentioned side ends on the major axis inwardly of the diaphragm ring 12, for example. More specifically, the above-mentioned screw members 21*a* and 21*a* are threadedly engaged with the above-mentioned support frame 20 so as to be moveable in relation to both the side ends on the major axis of the above-mentioned diaphragm ring 12. Further, the support frame 20 may be made of either a metal or a synthetic resin, but it is desirable to have rigidity greater than that of the diaphragm ring 12.

Figure 3A:
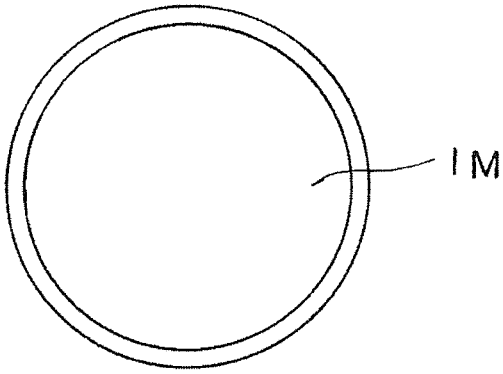
FIG. 3A is a plan view for explaining a process of manufacturing a diaphragm assembly.
Figure 3B:
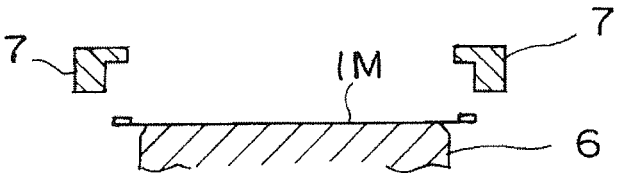
FIG. 3B is a sectional view for explaining the process of manufacturing the diaphragm assembly.

In order to obtain the diaphragm assembly of the microphone unit 10 as shown in FIGS. 1 and 2, a mother film 1M of the diaphragm 11 is first arranged on a cylindrical base 6 as shown in plan view in FIG. 3A and in section in FIG. 3B. The mother film 1M is in the shape of a precise circle.

Figure 4A:
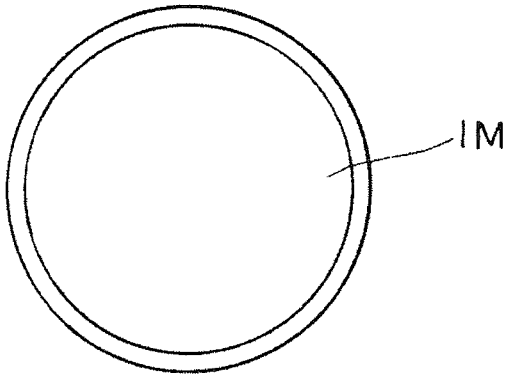
FIG. 4A is a plan view for explaining the process following FIG. 3.
Figure 4B:
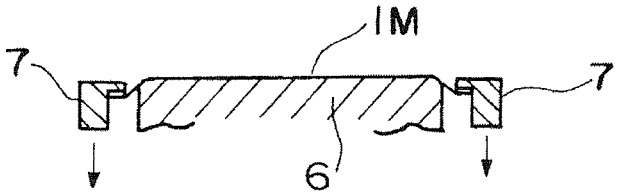
FIG. 4B is a sectional view for explaining the process following FIG. 3.

Next, as shown in plan view in FIG. 4A and in section in FIG. 4B, a weight 7 is provided for the whole periphery of the mother film 1M to uniformly tension the mother film 1M.

Figure 5A:
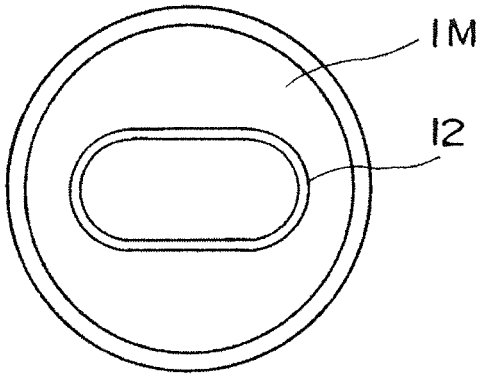
FIG. 5A is a plan view for explaining the process following FIG. 4.
Figure 5B:
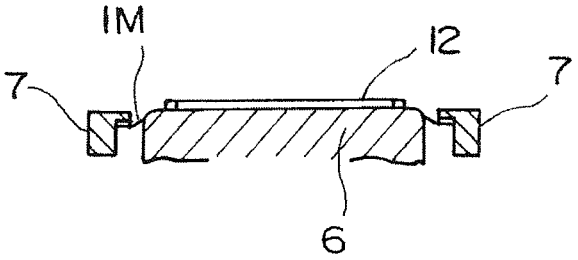
FIG. 5B is a sectional view for explaining the process following FIG. 4.
Figure 6A:
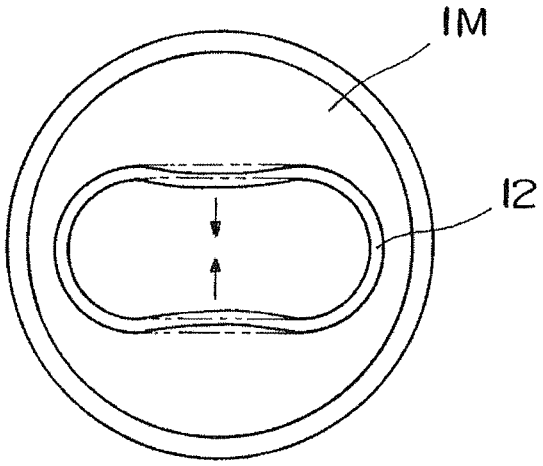
FIG. 6A is a plan view for explaining the process following FIG. 5.
Figure 6B:
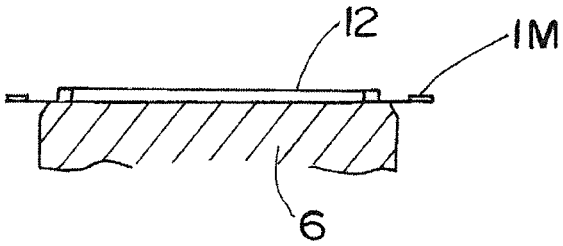
FIG. 6B is a sectional view for explaining the process following FIG. 5.

Then, in this situation, the oval-shaped diaphragm ring 12 is attached to the mother film 1M via an adhesive as shown in plan view in FIG. 5A and in section in FIG. 5B. The weight 7 is removed and the tension applied to the mother film 1M is released. In this situation, the tension of the mother film 1M which serves as the diaphragm 11 arranged inside the diaphragm ring 12 particularly causes the elongated side frame portions 12*a* and 12*a* of the diaphragm ring 12 to inwardly flex easily (towards the diaphragm 11) as shown in plan view in FIG. 6A in section in FIG. 6B. Thus, the tension of the mother film 1M inside the diaphragm ring 12 which serves as the diaphragm 11 is partially reduced to below the initial tension applied to the above-mentioned mother film 1M.

Figure 7:
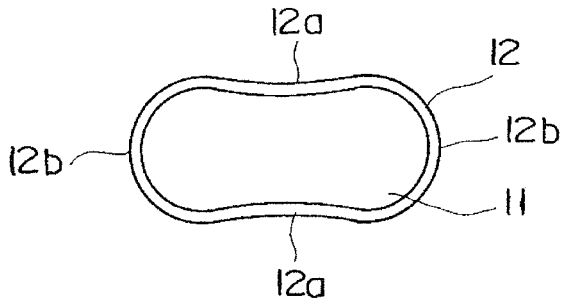
FIG. 7 is a plan view for explaining the process following FIG. 6.

Subsequently, as shown in FIG. 7 in plan view, the excess mother film 1M is cut off with a cutting knife etc. at the periphery portion of the frame of the diaphragm ring 12.

Now, the diaphragm assembly in which the diaphragm 11 is tensioned by the diaphragm ring 12 is obtained. However, the elongated side frame portions 12*a* and 12*a* of the diaphragm ring 12 are inwardly bent or flexed as described above. Therefore, the support frame 20 is arranged so as to surround the diaphragm assembly constituted by this diaphragm 11 and the diaphragm ring 12, and both the side ends on the major axis of the diaphragm ring 12 are pressed inwardly by the corrector member 21 provided at both the side ends on the major axis.

More particularly, the screw members 21*a* and 21*a* are threadedly attached to both the side ends on the major axis of the support frame 20, and tips of the screw members 21*a* and 21*a* are caused to project towards both the side ends on the major axis of the diaphragm ring 12.

Figure 8:
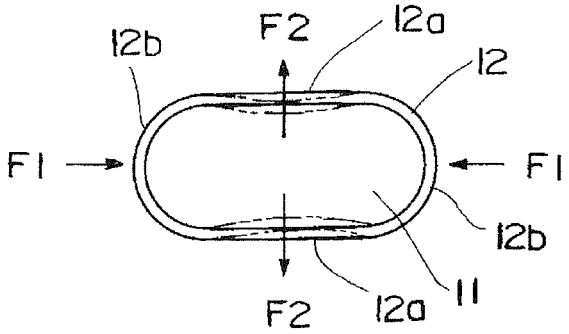
FIG. 8 is a plan view for explaining the process following FIG. 7.

Thereby, the screw members 21*a* and 21*a* press both the side ends on the major axis of the above-mentioned diaphragm ring 12 (arcuate frame portions 12*b* and 12*b*) by pressing force F1, as shown in the plan view of FIG. 8. Then, the displacement produced by the above-mentioned pressing force F1 may deform and outwardly (direction F2 in FIG. 8) stretch the elongated side frame portions 12*a* and 12*a* which face each other on the minor axis side of the diaphragm ring 12.

As a result, the diaphragm 11 tensioned by the diaphragm ring 12 is pulled in the direction to increase the size of the minor axis, thus obtaining the stable tension.

As such, according to the preferred embodiment in accordance with the present invention, both the side ends on the major axis (arcuate frame portions 12*b* and 12*b*) of the diaphragm ring 12 are pressed inwardly when the diaphragm 11 formed in the shape of an oval is held by the diaphragm ring 12 of the oval-shaped frame.

Thus, the pair of elongated side frame portions 12*a* and 12*a* which face each other on the minor axis side of the diaphragm ring 12 are deformed in the direction to stretch outwardly, and the diaphragm 11 is in a stable state where it is not bent or flexed.

That is to say, according to the electrostatic electroacoustic transducer in accordance with the present invention, it is easy to manufacture the oval-shaped diaphragm whose tension is stable. Further, since the diaphragm is in the shape of an oval, it is possible to efficiently use an interior space of a small electronic device, such as a mobile phone. Furthermore, since the effective area of the diaphragm is large, it is possible to obtain the effect of increasing its sensitivity.

It should be noted that, the preferred embodiments above have been described with reference to the case where the electrostatic electroacoustic transducer in accordance with the present invention is applied to a condenser microphone. However, as described above, the similar structure can be applied to not only a microphone but also a condenser-type headphone and a loudspeaker.

Further, in the preferred embodiments above, the screw members 21*a* and 21*a* are used as the pressing members in the corrector member 21. However, the present invention is not limited to the structure. For example, it can be arranged such that a bar-like pin component is fitted into a hole on the support frame 20 side to cause a tip thereof to project towards the diaphragm ring 12.

What is claimed is:

1. An electrostatic electroacoustic transducer, comprising a fixed electrode plate, a diaphragm arranged to face said fixed electrode plate and formed in the shape of an oval, a diaphragm holding member formed in the shape of a frame and in the shape of an oval for holding the periphery of said diaphragm, and a corrector member which presses inwardly from outside both side ends on a major axis of said oval diaphragm holding member, and opens and deforms outwardly a pair of opposed long sides on a minor axis side of said diaphragm holding member.

2. An electrostatic electroacoustic transducer as claimed in claim 1, wherein said corrector member comprises a support frame arranged so as to surround the periphery of said diaphragm holding member, and pressing members provided to project from the support frame side toward both the side ends on the major axis of said diaphragm holding member and inwardly press both the side ends on the major axis.

3. An electrostatic electroacoustic transducer as claimed in claim 2, wherein said pressing members are screws threadedly engaged with said support frame so as to be moveable in relation to both the side ends on the major axis of said diaphragm holding member.

* * * * *